United States Patent [19]

Kuhl et al.

[11] Patent Number: 4,614,850

[45] Date of Patent: Sep. 30, 1986

[54] VACUUM SWITCH FOR THE LOW-VOLTAGE RANGE, ESPECIALLY A LOW-VOLTAGE CONTACTOR

[75] Inventors: Wilfried Kuhl, Grosschwarzenlohe; Edwin Gemmel, Erlangen, both of Fed. Rep. of Germany

[73] Assignee: Siemens Aktiengesellschaft, Munich, Fed. Rep. of Germany

[21] Appl. No.: 676,825

[22] Filed: Nov. 30, 1984

[30] Foreign Application Priority Data

Dec. 5, 1983 [DE] Fed. Rep. of Germany ..... 3343918

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,087,034 | 4/1963 | Beers et al. | 200/144 B |
| 3,163,734 | 12/1964 | Lee | 200/144 |
| 3,950,628 | 4/1976 | Hruda | 200/144 B |
| 4,077,114 | 3/1978 | Sakuma | 29/622 |
| 4,365,127 | 12/1982 | Sakuma et al. | 200/144 B |

FOREIGN PATENT DOCUMENTS

| | | | |
|---|---|---|---|
| 1203349 | 10/1965 | Fed. Rep. of Germany . | |
| 1957829 | 12/1977 | Fed. Rep. of Germany . | |
| 2612129 | 11/1978 | Fed. Rep. of Germany . | |
| 1079013 | 8/1967 | United Kingdom | 200/144 B |
| 153318 | 5/1963 | U.S.S.R. | 200/144 B |
| 474058 | 9/1975 | U.S.S.R. | 200/144 B |

*Primary Examiner*—Robert S. Macon

*Attorney, Agent, or Firm*—Kenyon & Kenyon

[57] ABSTRACT

A vacuum switch for the low-voltage range, in particular, a low voltage contactor, comprising a vacuum switching tube having a switching chamber and a first contact rigidly arranged therein and a lead-in pin movable relative thereto having a second contact, wherein the vacuum switching tube has an insulating member which is surrounded on the vacuum side at least partially by shielding. The shielding is arranged as a concentric hollow cylinder and the insulating member comprises a ring shaped member, preferably of ceramic. The axial length of the shielding cylinder is at least 1.5 times that of the ring. A vacuum switch having a short insulating path thus can be constructed cost-effectively and which has the capability for a high number of switching cycles.

8 Claims, 1 Drawing Figure

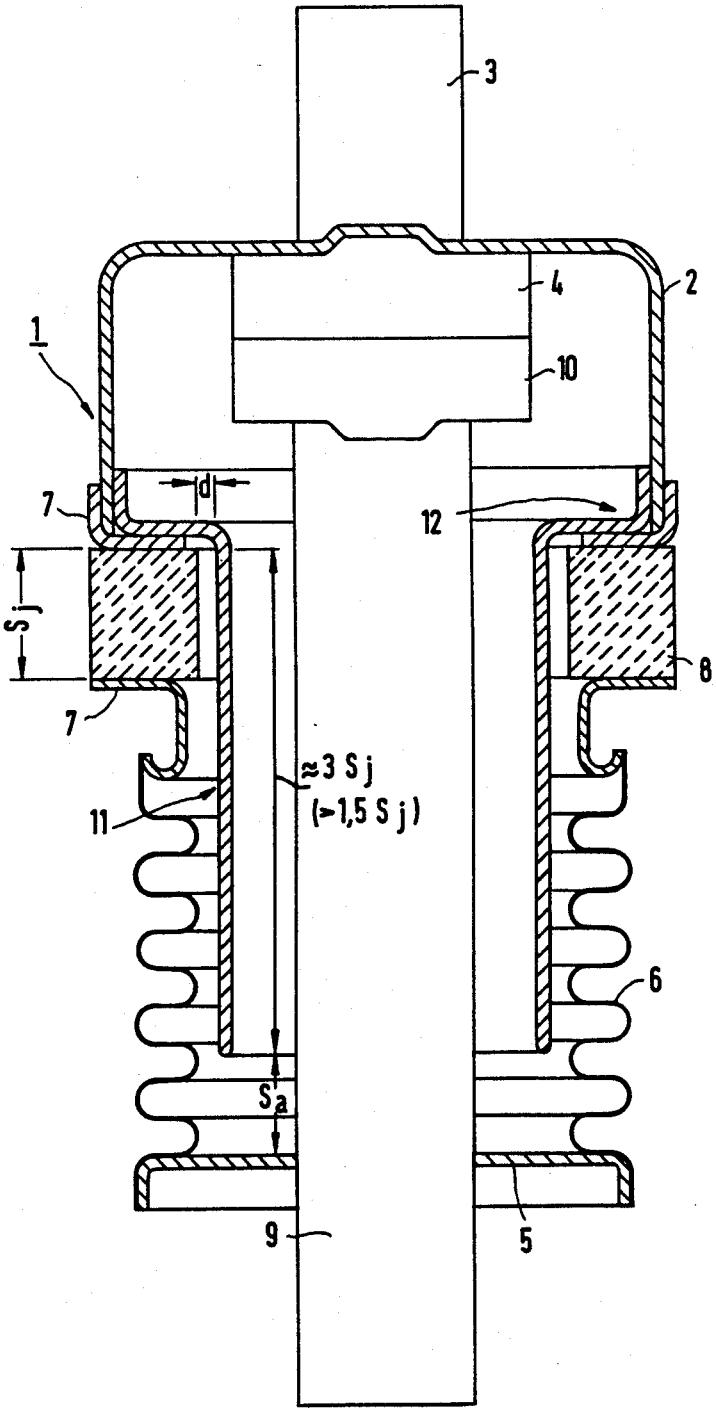
3
4
2
1
10
d
7
12
Sj
8
7
≈3 Sj
(>1,5 Sj)
11
6
Sa
9
5

VACUUM SWITCH FOR THE LOW-VOLTAGE RANGE, ESPECIALLY A LOW-VOLTAGE CONTACTOR

BACKGROUND OF THE INVENTION

The present invention relates to the field of vacuum switches for the low-voltage range, and especially low-voltage contactors comprising a vacuum switching tube having a vacuum switching chamber and a first contact fixedly arranged therein, as well as a lead-in pin movable relative thereto having a second contact, and wherein the vacuum switching tube has an insulating path or member which is surrounded on the vacuum side, at least partially, by shielding.

Every switch contains a high-resistance insulating path which must not change, as far as possible, during the entire life of the switch. In vacuum switches, dust and water vapor and the like can precipitate on the insulator on the side exposed to the atmosphere and, on the other hand, metal vapor from the evaporating contact material can precipitate on the vacuum-side surface, and thereby adversely affect the insulating capability of the insulator. Therefore, shielding on the vacuum side of the insulators is required in order to prevent metal vapor condensation. Depending on the voltage applied, such shielding can in part be rather expensive due to the mechanical design.

In low-voltage switches only relatively short insulating paths are required for the potential isolation because of the low nominal voltage. In practice, therefore, insulator shapes also are used besides coaxial insulators, which have a radial insulating path. A low-voltage vacuum switch is described, for instance, in DE-AS 19 57 829 in which a base plate of the switching tube is designed as an insulator and on the vacuum side of which is provided a lid-shaped conical shield. From US-LP 4077 M4, a vacuum switch is further known in which the insulator, as part of the switching chamber, forms the entire hollow cylinder, and the shielding is formed by a concentric ring disposed therein. The inner ring, which has a length smaller than the insulator, substantially encloses the contact region including the rigid contact and the contact pin and attached contact movable relative to the rigid contact. Other vacuum switches also include shielding constructed from several individual parts.

It is desired, for cost reasons, to make the insulating path as short as possible. In contrast with the described state of the art, in the present invention only a part of the switching tube is designed as ceramic, for which purpose substantially ring-shaped elements can be used. Even if short insulators are electrically sufficient for the low-voltage range, certain requirements with respect to the shielding must nevertheless be met. For example, it must be taken into consideration that, especially if switching tubes are used as contactors for the low-voltage range, particularly large numbers of switching operations of, for instance, several million switching cycles, are required. With the shielding customary to date, some metal vapor molecules can, in the course of time, migrate to the insulator by reflection, condense there and thus form an electrically conducting coating.

SUMMARY OF THE INVENTION

It is therefore an object of the present invention to provide a vacuum switch having a short insulating path with a simple shielding which is sufficiently effective over the entire life of the switch.

The above and other objects of the present invention are achieved in a vacuum switch wherein the insulating path is an insulating ring and the shielding is arranged as a concentric hollow cylinder within the insulating path, the axial length of the shielding being at least 1.5 times that of the insulating ring. The insulating ring is preferably ceramic.

The invention therefore takes an approach in contrast to the state of the art. An insulator thus can be used which is relatively short for the low-voltage application wherein it is ensured by the axial length of the shielding that within the entire life of the switch no vapor is deposited on the ceramic and the switching capacity is thereby not reduced. The length of the hollow shielding cylinder is preferably designed so that its distance from the base plate of the switching tube or from the electric counter potential is at least as large as the burn-off to be expected during the entire life of the contacts, which burn-off causes an axial shortening of the length of the switching tube. Preferably, the shielding cylinder can have approximately three times the length of the insulator ring.

The shielding cylinder preferably is arranged within the vacuum switching tube as closely as possible to the insulator and an associated sealing spring bellows. The outer circumference of the shielding cylinder however, should have sufficient spacing from the inside circumference of the insulator ring. Preferably, a gap of between 0.5 and 3 mm is formed between the inside of the insulator and the outside of the shielding cylinder. This gap ensures that with consideration of manufacturing tolerances, no flush short circuit can occur and that, on the other hand, the gap length is smaller than the expected free path lengths of the evaporating particles from the switching gap between the contacts.

Overall, a vacuum switch for low-voltage installations can be constructed relatively simply with the shielding according to the invention, so that manufacture is cost-effective.

BRIEF DESCRIPTION OF THE DRAWING

The invention will be described in greater detail in the following detailed description with reference to the single drawing figure which shows a cross sectional view of a vacuum switch constructed in accordance with the invention.

DETAILED DESCRIPTION

With reference now to the drawing figure, reference numeral 1 generally designates the entire vacuum switching tube. The switching tube comprises a cup-like part 2 defining the upper part of the switching chamber, to which a first lead-in pin 3 having a contact 4 located in the switching chamber 2 is rigidly attached. Opposite thereto is mounted on a support means or 5, in a vacuum-tight manner, metallic spring bellows 6 which is movable in the axial direction and which is connected to the switching chamber 2 via an insulator ring 8, preferably of ceramic. For making the vacuum-tight connection between metal and insulator parts, mounting rings 7 made of a material which has thermal expansion properties so that they can be joined vacuum-tight, on the one hand, to metal and, on the other hand, to ceramic, are used. A movable contact pin or operating means 9 which carries at its upper end a contact 10 is inserted into the base plate 5.

In the drawing figure, the switch is shown in the closed condition. The design of the switch contacts themselves will not be discussed in detail herein.

Concentrically with the insulator ring 8 having a length $s_j$ there is disposed in the switching chamber a hollow cylinder 11, by which the ceramic 8 is shielded from the switch contacts. The hollow cylinder 11 has, at its upper end, i.e., the end facing the switch contacts in the figure, a tubular enlargement so that a cap 12 is formed which makes fastening to the switch chamber 2 possible. The cap 12 is soldered or welded to parts 2 and 7.

The shielding cylinder 11 has, for instance, approximately three times the length of the insulator $s_j$. It must have however, at least 1.5 times the length of the insulator ring 8, the upper limit of the length being designed so that the distance $s_a$ from the base plate 5 of the switching tube is at least as large as the burn-off to be expected during the entire life of the contacts is, for instance, in mm.

Between the outside wall of the shielding cylinder 11 and the inside wall of the insulator ring 8 or the metal bellows 6, respectively, a gap d as narrow as possible should exist which is smaller than the free path lengths of the evaporating particles. However, manufacturing tolerances must be taken into consideration so that no electrically conducting connection can be produced by the shielding cylinder due to the expected unroundness, for instance, of the insulator rings. A gap width d in the range of 0.5 to 3 mm has been found to be feasible and suitable.

Life tests have shown that all requirements of practice are met with the relatively simple design of the shielding. With switching cycles of several million, there also was no vapor deposit on the ceramic and the switching capacity was still fully guaranteed. Thus, a cost-effective vacuum switch for low voltage can be constructed.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. A vacuum switch for low-voltages comprising support means, a vacuum switching tube disposed on said support means defining a vacuum switching chamber and first contact means rigidly disposed therein, second contact means movable with respect to the first contact means in said chamber, said second contact means being operable by operating means extending into said switching chamber, the vacuum switching tube having insulating means coupling said switching tube and said support means, said insulating means surrounded on a side facing the vacuum in said switching chamber at least partially by shielding means, the shielding means comprising hollow cylinder means disposed concentrically about said operating means, said insulating means comprising insulating ring means disposed concentrically about said shielding means, the axial length of said shielding means being at least 1.5 times the length of said insulating ring means, and further comprising spring bellows means coupling said insulating ring means and said support means, the outer circumference of the shielding means being radially spaced from the inside circumference of said spring bellows means by a small distance.

2. The vacuum switch recited in claim 1, wherein the length of the shielding means is designed so that the distance from the lower edge of said shielding means to said support means is at least as large as the burn-off expected during the entire life of said first and second contact means.

3. The vacuum switch recited in claim 1, wherein the shielding means is approximately three times the length of the insulating ring means.

4. The vacuum switch recited in claim 1, wherein the outer circumference of the shielding means is radially spaced from the inside circumference of the insulating ring means by a small distance.

5. The vacuum switch recited in claim 4, wherein a radial gap of between 0.5 and 3 mm exists between the inner circumference of said insulating means and the outer circumference of said shielding means.

6. The vacuum switch recited in claim 1, wherein said switching chamber is defined at an upper end thereof by an inverted cup-shaped member, said first contact means being fixedly attached thereto, and wherein the shielding means is attached to the insulating ring means in the switching chamber on that side of the ring means which is coupled to said cup shaped member.

7. The vacuum switch recited in claim 6, wherein the shielding means has a tubular enlargement adjacent the area where the shielding means is attached to the insulating ring means.

8. The vacuum switch recited in claim 1, wherein said insulating ring means comprises ceramic.

* * * * *